US007086731B1

(12) United States Patent
Farnung et al.

(10) Patent No.: US 7,086,731 B1
(45) Date of Patent: Aug. 8, 2006

(54) PLATEN ASSEMBLY FOR AN INK JET PRINTER

(75) Inventors: Kirk D. Farnung, Rochester, NY (US); Sabrina J. Diol, Pittsford, NY (US); Frank Razavi, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 11/052,349

(22) Filed: Feb. 7, 2005

(51) Int. Cl.
*B41J 2/185* (2006.01)

(52) U.S. Cl. ..... 347/104; 347/22; 347/33; 347/36; 400/654

(58) Field of Classification Search ..... None
See application file for complete search history.

(56) References Cited

U.S. PATENT DOCUMENTS 5,291,227 A * 3/1994 Suzuki ..... 347/104
5,594,486 A * 1/1997 Kiyohara ..... 347/104
6,471,351 B1 * 10/2002 Ishikawa et al. ..... 347/104

* cited by examiner

*Primary Examiner*—Andrew H. Hirshfeld
*Assistant Examiner*—Jill E. Culler
(74) *Attorney, Agent, or Firm*—Frank Pincelli

(57) ABSTRACT

A platen assembly for an ink jet printer and method of operating an ink jet printer. The platen assembly includes a platen member having at least one channel therein for receiving a rotatable platen rod and a skive residing in the channel adjacent to the rotatable platen rod. The skive has an edge thereof engaging a surface of the rotatable platen rod and removing debris therefrom. A slot is provided through the bottom wall of the channel for allowing debris removed from the rotatable platen rod to pass there through and out of the channel. A control unit is provided for controlling operation of a motor used to rotated the platen rod at desired times.

24 Claims, 4 Drawing Sheets

PLATEN ASSEMBLY FOR AN INK JET PRINTER

FIELD OF THE INVENTION

The present invention is directed to ink jet printers and more particularly to a platen assembly for use in an ink jet printer and method of borderless printing.

BACKGROUND OF THE INVENTION

Currently in platens for ink jet printers, a foam pad is positioned below the ink jet head to allow the ink to flow down and through it. The ink then goes into a waste tank. The waste tank will have some sort of pad to absorb the ink that was placed in the tank. When the head of an ink jet printer is firing ink down on a media, ink can build up on the platen foam at the edges of the receiving media when making borderless prints. This build-up can get on the back side of the media. The problem of ink build-up is especially prevalent when pigment inks are used and even more severe during borderless printing.

Thus, there is a need to provide a platen assembly for ink jet printing that avoids the problem of ink build-up on a platen that occurs during borderless printing with pigmented inks.

SUMMARY OF THE INVENTION

In accordance with one aspect of the present invention there is provided a platen assembly for an ink jet printer comprising:

(a) a platen member having at least one channel therein generally perpendicular to a direction of travel of a print medium over the platen member;

(b) a rotatable platen rod residing in the channel;

(c) a skive residing in the channel adjacent to the rotatable platen rod having an edge thereof engaging a surface of the rotatable platen rod and removing debris therefrom; and (d) at least one slot through a bottom wall of the channel for allowing debris removed from the rotatable platen rod to pass there through and out of the channel.

In accordance with another aspect of the present invention there is provided an ink jet printer comprising:

(a) an ink jet print head;

(b) a platen member having at least one channel therein generally perpendicular to a direction of travel of a print medium over the platen member, the platen member residing beneath the ink jet print head;

(c) a rotatable platen rod residing in the channel;

(d) a skive residing in the channel adjacent to the rotatable platen rod having an edge thereof engaging a surface of the rotatable platen rod and removing debris therefrom; and (e) at least one slot through a bottom wall of the platen member in communication with the channel for allowing debris removed from the rotatable platen rod to pass there through and out of the channel.

In accordance with yet another aspect of the present invention there is provided a method of performing borderless ink jet printing comprising the steps of:

(a) supporting a sheet of print media on a platen member, the platen member having a channel therein;

(b) providing a rotatable a platen rod in the channel;

(c) printing with an ink jet print head onto the sheet and printing beyond each of a plurality of side edges of the sheet, some of the ink from the ink jet print head striking the platen rod; and (d) doctoring the platen rod to remove debris therefrom by rotating the platen rod.

In accordance with yet still another aspect of the present invention there is provided a method of removing ink debris from an ink jet platen of an ink jet printer comprising the steps of:

(a) rotatably supporting a platen rod in a channel of a platen member;

(b) rotating the platen rod; and (c) doctoring the rotating platen rod to remove debris therefrom.

These and other aspects, objects, features and advantages of the present invention will be more clearly understood and appreciated from a review of the following detailed description of the preferred embodiments and appended claims and by reference to the accompanying drawings.

BRIEF DESCRIPTION OF THE DRAWINGS

In the detailed description of the preferred embodiments of the invention presented below, reference is made to the accompanying drawings in which.

DETAILED DESCRIPTION OF THE INVENTION

Figure 1:
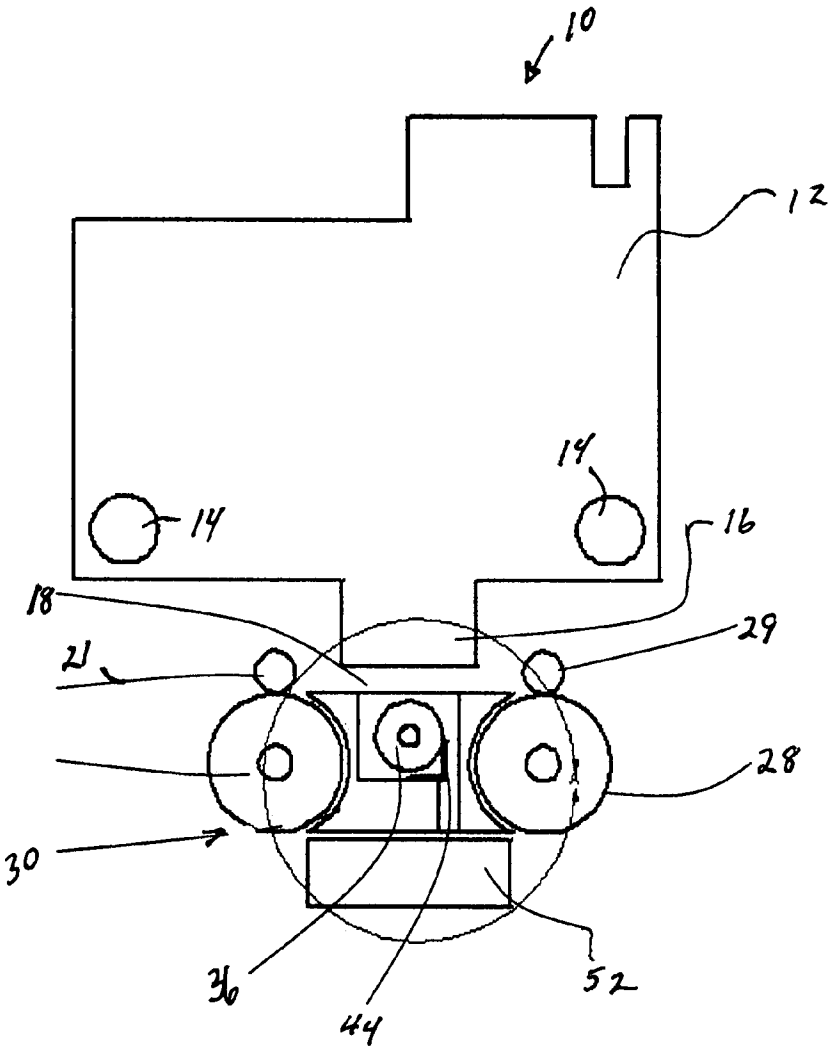
FIG. 1 illustrates a side view of a printer receiving path of an ink jet printer with platen assembly made in accordance with the present invention.
Figure 2:
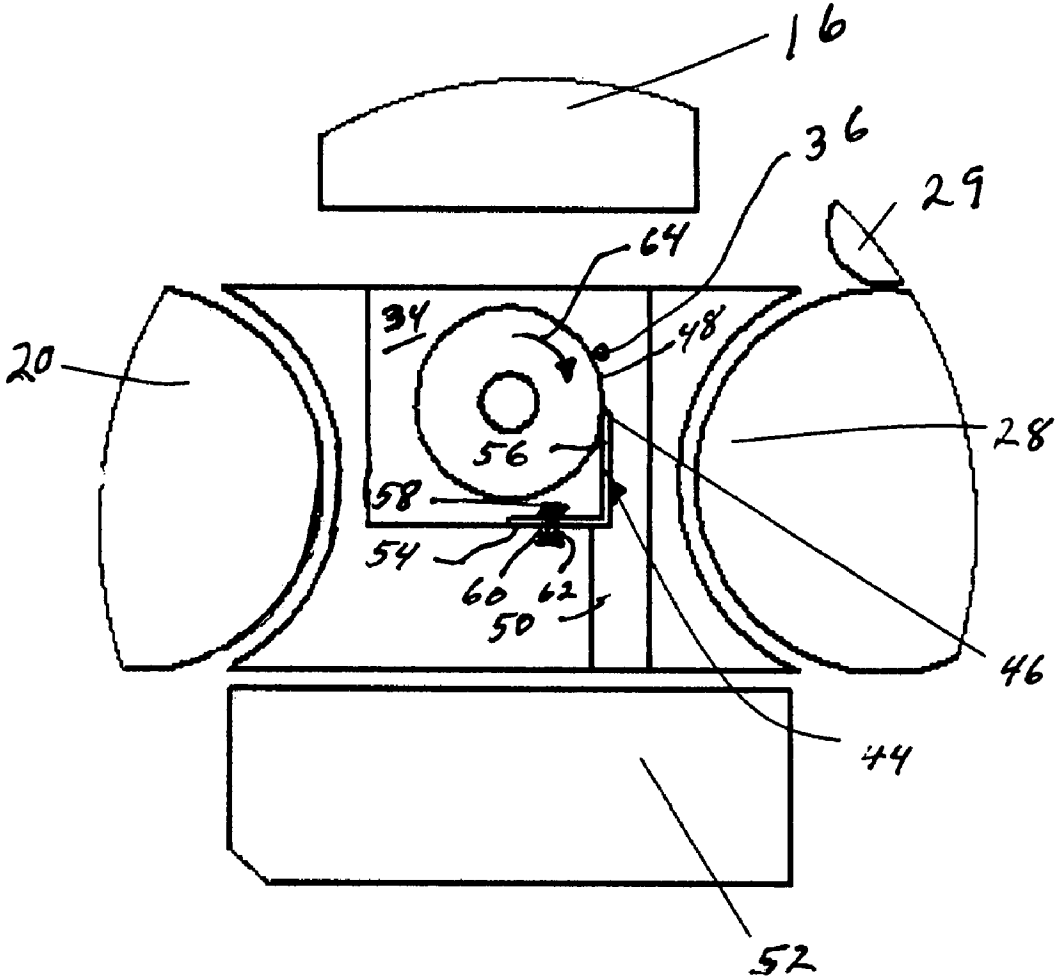
FIG. 2 is an enlarged view of the platen assembly made in accordance with the present invention and the surrounding area of the printer as illustrated by line 2—2.
Figure 3:
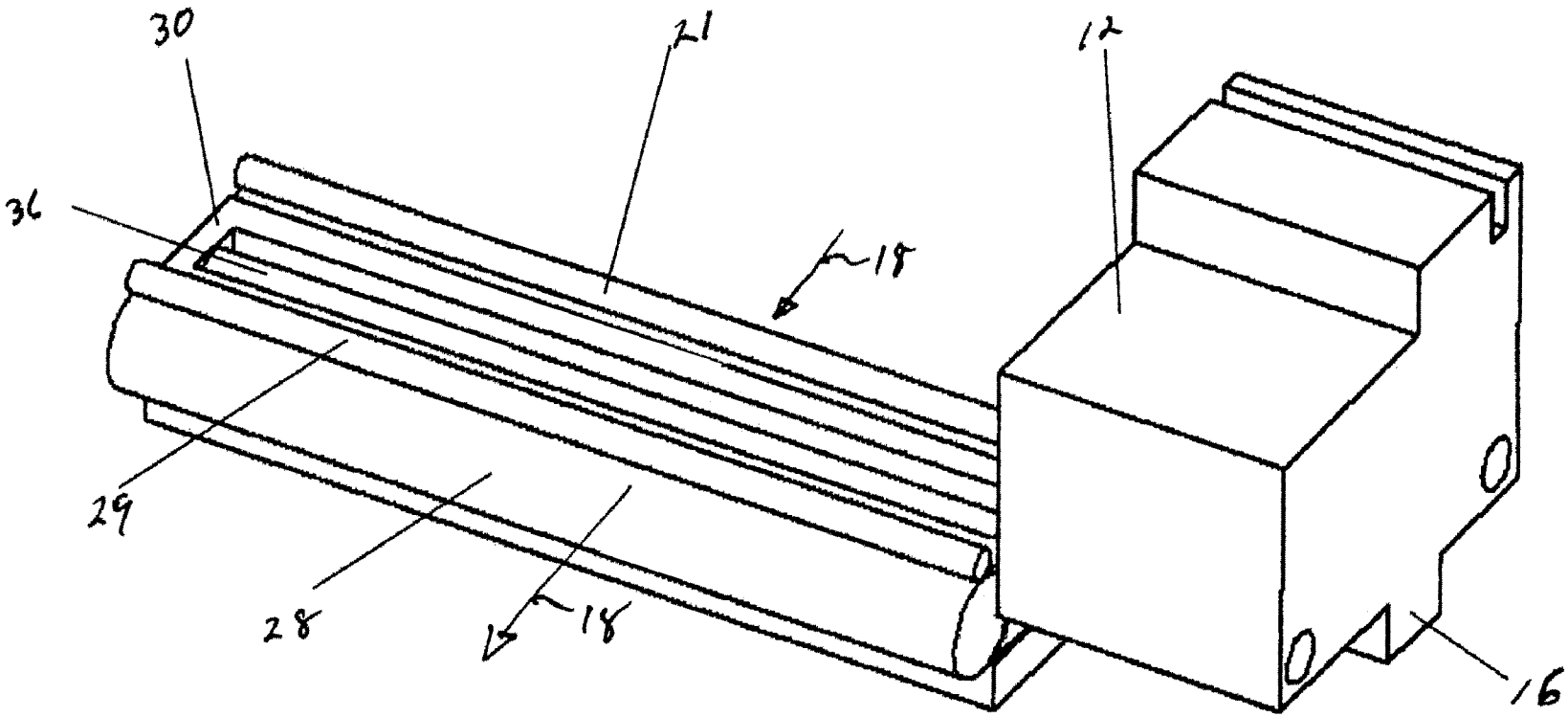
FIG. 3 is a perspective view of the printer receiving path and platen assembly illustrated in FIG. 1.

Referring to the figures, there is illustrated a printing assembly 10 of an ink jet printer made in accordance with the present invention. The printing assembly 10 includes a print head assembly 12 mounted on a pair of support rods 14. The transport head assembly 12 moves along support rods 14 such that an ink jet print head 16 on head transport assembly 12 will cross a media 24 that moves along media transport path 18. The printing assembly 10 includes a first pair of drive rollers 20, 21 and a second pair of drive rollers 28, 29 disposed on opposite sides of a platen assembly 30. The drive rollers 20, 21, 28, 29 are used to move media 24 over platen assembly 30 along transport path 18.

Figure 4:
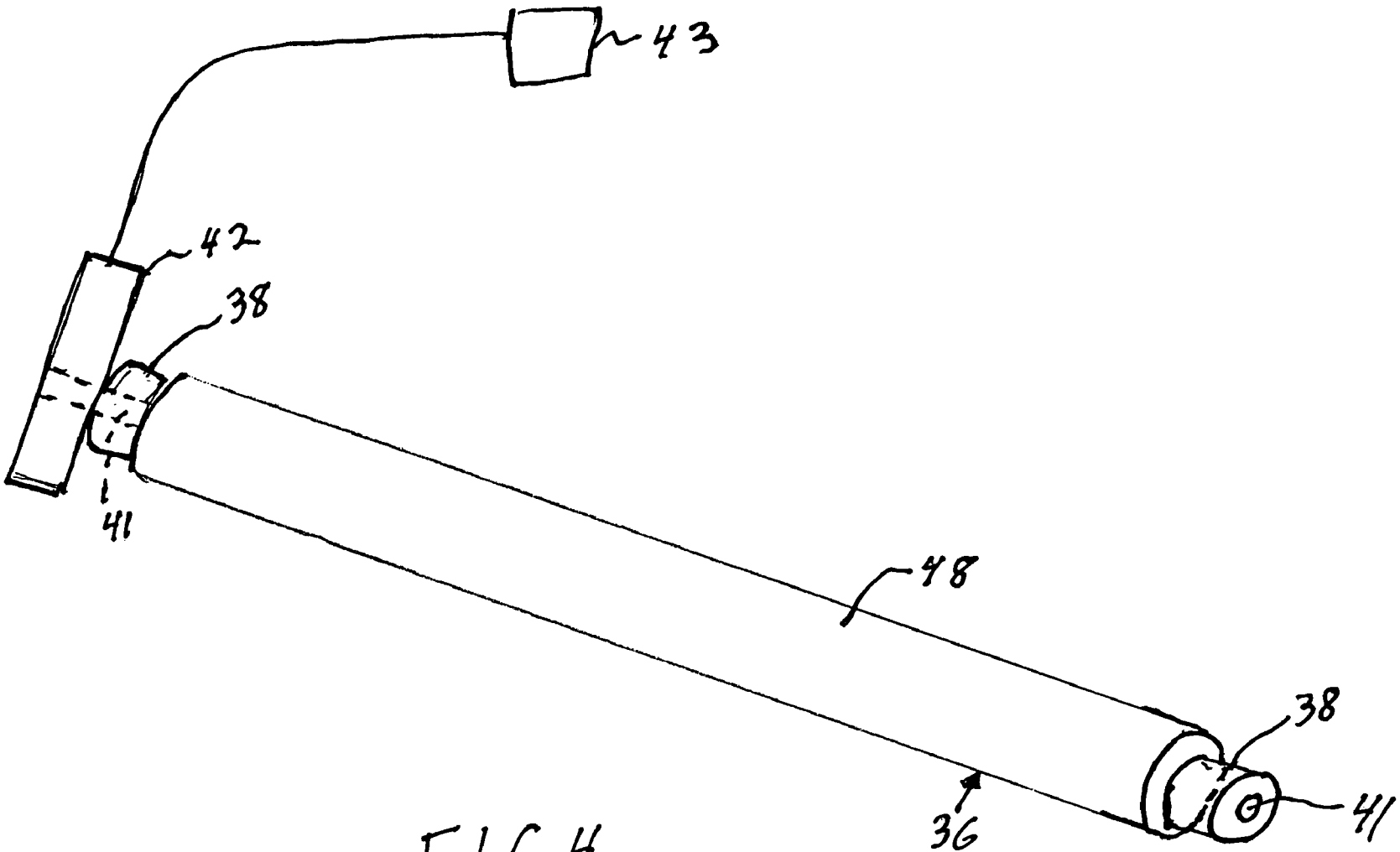
FIG. 4 is a partial perspective view of the rotatable platen rod, drive motor, control unit, and supporting bushings of the assembly of FIG. 1.

The platen assembly 30 includes a platen member 32 having a channel 34 that is positioned substantially perpendicular to the direction of travel of the media 24 over the platen member 32. Mounted within the channel 34 is a rotatable platen rod 36. In the particular embodiment illustrated, the rotatable platen rod 36 is rotatably mounted by any appropriate means. In the particular embodiment illustrated, the platen rod 36 is rotatably mounted by a pair of bushings 38 at its lateral ends 40, 41. A motor 42 (see FIG. 4) is connected to end 40 of rotatable platen rod 36 so as to cause the rotatable platen rod 36 to be rotated when the motor 42 is appropriately activated. A control unit 43 is provided for controlling operation of the motor 42. In the embodiment illustrated, the motor 42 comprises a stepper motor and control unit 43 is a computer that can be programmed as desired to operate the motor 42 and the various other components of the ink jet printer. A skive 44 (doctor blade) is provided in the channel and has an outer edge 46 that is designed to contact the outer surface 48 of the rod 36 such that when the motor 42 rotates the rod 36, the skive 44 will engage the surface 48 and remove debris therefrom. The platen member 32 is further provided with at least one slot 50 which forms a passageway which extends from the channel 34 through the bottom wall 46 of the platen member 32 such that debris removed by the skive 44 from the rotatable platen rod 36 passes there through out of the channel 34 into a waste receptacle 52.

The particular embodiment illustrated in the skive 44 has a generally L-shaped configuration having mounting leg 54 secured to platen member 32 by any appropriate means and an engagement leg 56 which terminated in edge 46 for contacting rod 36. In the particular embodiment illustrated, the skive 44 is secured by a plurality of threaded screws 58 (only one shown) which extend through openings 60 in the lower leg 54 into threaded openings 62 in platen member 32. It is to be understood that the skive 44 may be secured to platen member 32 by any appropriate fasting/mounting technique.

The rotatable platen rod 36 and skive 44 are made of appropriate materials so that the ink debris on the rod 36 will be easily removed. For example, but not by way of limitation, rod 36 may be made of material such as steel or may be made out of a suitable plastic material. Likewise the skive 44 may be made out of metal, such as steel or plastic as appropriate. The materials from which the skive and roller are made are such as to allow appropriate removal of debris without any excess wear on the skive 44 or rod 36. In the particular embodiment illustrated, the rod 36 is made out of a steel material and the skive is also made out of steel material.

In order to more clearly understand the present invention, a brief description of its operation will now be discussed. As is typical with ink jet print head assemblies, the print head 16 is moved across the media 24 as it is transported over the platen assembly 30. Various inks may be passed through the ink jet head 16 as appropriate for example, but not limited to, dyes and pigmented inks. Over time there may occur the build up of residue on the rod 36. Accordingly, periodically the rod 36 is rotated in the direction indicated by arrow 64 for removing debris from the outer surface 48 by skive 44, the debris falling through slot/passage 50 into waste receptacle 52. The control unit 43 activates motor 42 for removing debris from rod 36 as programmed. In the embodiment described, the rotatable platen rod 36 is rotated periodically (intermittent).

However, the rod 36 may be rotated in a desired sequence. For example but not limited to, the rod may be rotated continuously or only during times when an ink is being sprayed on media 24 or during specific times when pigmented inks are being applied and/or when it is known that borderless printing is occurring. Thus, the activation of motor 42 may be provided so as to accommodate the type of printing and/or type of ink being used for printing.

It is to be understood that various other changes and modifications may be made without departing from the scope of the present invention, the present invention being limited by the claims that follow.

| PARTS LIST | |
|---|---|
| 10 | printing assembly |
| 12 | print head assembly |
| 14 | support rods |

-continued

| PARTS LIST | |
|---|---|
| 16 | ink jet print head |
| 18 | media transport path |
| 20, 21 | first drive rollers |
| 24 | media |
| 28, 29 | second drive rollers |
| 30 | platen assembly |
| 34 | channel |
| 36 | platen rod |
| 38 | bushings |
| 40, 41 | lateral ends |
| 42 | motor |
| 43 | control unit |
| 44 | skive |
| 46 | outer edge |
| 48 | outer surface |
| 50 | slot |
| 52 | waste receptacle |
| 54 | mounting leg |
| 56 | engagement leg |
| 58 | threaded screws |
| 60 | opening |
| 62 | threaded openings |
| 64 | arrow |
| 50 | slot/passage |

The invention claimed is:

1. A platen assembly for an ink jet printer comprising:

(a) a platen member having at least one channel therein generally perpendicular to a direction of travel of a print medium over the platen member;

(b) a rotatable platen rod residing in the channel;

(c) a skive residing in the channel adjacent to the rotatable platen rod having an edge thereof engaging a surface of the rotatable platen rod and removing debris therefrom; and (d) at least one slot through a bottom wall of the channel for allowing debris removed from the rotatable platen rod to pass there through and out of the channel.

2. A platen assembly for an ink jet printer as recited in claim 1 further comprising:

a waste receptacle beneath the at least one slot.

3. A platen assembly for an ink jet printer as recited in claim 1 further comprising:

a motor for driving rotation of the platen rod.

4. A platen assembly for an ink jet printer as recited in claim 1 further comprising:

a motor for driving intermittent rotation of the platen rod.

5. A platen assembly for an ink jet printer as recited in claim 1 wherein:

the ink jet printer prints using pigment inks.

6. A platen assembly for an ink jet printer as recited in claim 1 wherein:

the platen rod is made of metallic material.

7. A platen assembly for an ink jet printer as recited in claim 1 wherein:

the platen rod is made of steel.

8. A platen assembly for an ink jet printer as recited in claim 1 wherein:

the skive is made of a metallic material.

9. A platen assembly for an ink jet printer as recited in claim 1 wherein:

the skive is made of steel.

10. A platen assembly for an ink jet printer as recited in claim 1 wherein:

the platen rod is made of a plastic material.

11. A platen assembly for an ink jet printer as recited in claim 1 wherein:

the skive is made of a plastic material.

12. A platen assembly for an ink jet printer as recited in claim 1 wherein:

the skive is made of plastic.

13. An ink jet printer comprising:

(a) an ink jet print head;

(b) a platen member having at least one channel therein generally perpendicular to a direction of travel of a print medium over the platen member, the platen member residing beneath the ink jet print head;

(c) a rotatable platen rod residing in the channel;

(d) a skive residing in the channel adjacent to the rotatable platen rod having an edge thereof engaging a surface of the rotatable platen rod and removing debris therefrom; and (e) at least one slot through a bottom wall of the platen member in communication with the channel for allowing debris removed from the rotatable platen rod to pass there through and out of the channel.

14. An ink jet printer as recited in claim 13 further comprising:

a waste receptacle disposed beneath the at least one slot.

15. An ink jet printer as recited in claim 13 further comprising:

a motor for driving rotation of the platen rod.

16. An ink jet printer as recited in claim 13 further comprising:

a motor for driving intermittent rotation of the platen rod.

17. An ink jet printer as recited in claim 13 wherein:

the ink jet printer prints using pigment inks.

18. A method of performing borderless ink jet printing comprising the steps of:

(a) supporting a sheet of print media on a platen member, the platen member having a channel therein;

(b) providing a rotatable platen rod in the channel;

(c) printing with an ink jet print head onto the sheet and printing beyond each of a plurality side edges of the sheet, some of the ink from the ink jet print head striking the platen rod; and (d) doctoring the platen rod to remove debris therefrom by rotating said platen rod.

19. A method as recited in claim 18 further comprising the steps of:

(a) allowing the debris to fall through at least one slot in the bottom of the channel; and (b) collecting the debris falling through the at least one slot.

20. A method as recited in claim 18 further comprising the steps of:

(a) allowing the debris to fall through at least one slot in the bottom of the channel; and (b) collecting the debris falling through the at least one slot in a waste receptacle positioned beneath the at least one slot.

21. A method as recited in claim 18 wherein:

the ink delivered from the ink jet print head is a pigment ink.

22. A method as recited in claim 18 wherein:

the rotating step is performed intermittently.

23. A method of removing ink debris from an ink jet platen of an ink jet printer comprising the steps of:

(a) rotatably supporting a platen rod in a channel of a platen member;

(b) rotating the platen rod; and (c) doctoring the rotating platen rod to remove debris therefrom.

24. A method as recited in claim 23 further comprising the steps of:

(a) allowing the debris to fall through at least one slot in the bottom of the channel; and (b) collecting the debris falling through the at least one slot.

* * * * *